US005581945A

United States Patent [19]

Baumle

[11] Patent Number: 5,581,945

[45] Date of Patent: Dec. 10, 1996

[54] SLIDING VENT FOR WINDOWS

[75] Inventor: Ralf Bäumle, Zell, Germany

[73] Assignee: Roto Frank AG, Leinfelden-Echterdingen, Germany

[21] Appl. No.: 496,735

[22] Filed: Jun. 29, 1995

[30] Foreign Application Priority Data

Jun. 29, 1994 [DE] Germany ..... 9410496 U

[51] Int. Cl.[6] ..... E06B 7/02

[52] U.S. Cl. ..... 49/38

[58] Field of Search ..... 52/198, 199, 302.1, 52/302.6; 49/73.1, 94, 96, 38

[56] References Cited

U.S. PATENT DOCUMENTS 4,565,044 1/1986 Takahara ..... 52/302.1

FOREIGN PATENT DOCUMENTS 8802736 6/1990 Netherlands ..... 52/302.1
2131845 6/1984 United Kingdom ..... 52/198
2252110 7/1992 United Kingdom ..... 52/302.1

*Primary Examiner*—Brian K. Green
*Assistant Examiner*—Curtis A. Cohen
*Attorney, Agent, or Firm*—Pepe & Hazard

[57] ABSTRACT

A slide ventilation assembly for a roof window installation has a multiplicity of elongated walls defining an enclosed space with two of the walls extending at 90° to one another, and a connector wall piece disposed between the adjacent ends of the two walls. The two walls have apertures spaced along the length thereof, and elongated ventilation slides are slidably mounted on them. The slides have apertures spaced along the length thereof and are slidable between a first position in which their apertures are aligned with the apertures in the walls. A connector connects the slides for concurrent movement thereof, and a manipulatable operator is provided to move the slides to effect alignment of the apertures in the slides with the apertures in the walls to allow air to pass through the walls and enclosed space. The ventilation assembly is disposed between the sash and window fame in the roof so that one of the two walls is in communication with the interior of the building and the other wall is in communication with the exterior in the closed position of the sash.

16 Claims, 3 Drawing Sheets

SLIDING VENT FOR WINDOWS

BACKGROUND OF THE INVENTION

The invention concerns a slide ventilation assembly for windows with an enclosed space, two walls of which are equipped with ventilation slides which are connected with one another for joint operation, so that it is possible to bring openings of the ventilation slides into and out of alignment with openings in the walls.

A slide ventilation assembly of this type is known from German Patentschrift-PS 3 034 765. This slide ventilation assembly is provided by an elongated area with a rectangular cross-section, the ventilation slides being arranged on opposite sides, pointing to the interior and to the exterior. A slide ventilation design of this kind, irrespective of whether it is located on the window frame or on the window sash, requires much space which is lost for the glass surface of the window. Moreover, in addition to the two walls for the ventilation slide, there are two profile bars for the narrow sides and the ends of the frame, therefore at least six wall parts are required in order to make the frame of this slide ventilation assembly.

SUMMARY OF THE INVENTION

The task of the invention is to design a slide ventilation assembly of the above-mentioned kind so that it is simple to make and saves space when installed.

The task is solved in accordance with the invention by means of the fact that the two walls equipped with ventilation slides essentially are disposed at a 90° angle to one another and that a wall piece providing a recess is disposed between the adjacent ends of these two walls.

The solution in accordance with the invention makes space-saving installation possible since the ventilation slide assembly can be integrated into the recess area so that practically no additional space is required. This is independent of whether the slide ventilation assembly is located on the window frame or on one of the frame parts of the window sash. For example, it is possible to cut out a part on a wooden frame and to insert the ventilation slide assembly which simultaneously assumes the function of the recess in this area.

The slide ventilation assembly is made simply, in this regard it being especially advantageous if the walls and the wall piece made as a fold are designed as an angle section and if this angle section can be combined with a cover for the enclosed frame.

In the closed position, the slide ventilation assembly has good sealing and good heat insulation, which can be improved additionally by equipping at least one of the ventilation slides with additional sealing measures. For example, it is possible that one of the slides is held by its edges in U-shaped guides and has projecting tongues pushing the edges on the inside of the ventilation slide against the guide. In this way the ventilation slide is pushed against the wall and better sealing is obtained. At the same time irregularities of measurements can be compensated and easy operation of the ventilation slide concerned can be obtained in this way. This effect can be improved still further by having the tongues have knobs or protuberances. Also it is advisable to arrange the tongues along the opposite edges offset from one another by a half spacing in order to reduce the friction further in this way.

Better sealing and heat insulation also can be achieved by having at least one ventilation slide bear a fiber web on the part turned to the wall. Also it is possible to locate the fiber web on the part of the wall adjacent to the ventilation slide.

A suitable fastening of the slide ventilation assembly in the roof window installation is achieved by having the covering of the angled section have connecting elements for connection with a frame part.

Fresh air also can be fed to the slide ventilation through an additional enclosed space which is connected with the outside air through a filter.

Parts of a lip seal can be located on the wall piece providing the recess. This may include a sealing lip as well as the head for installing the sealing. A double lip seal also can be installed.

The slide ventilation assembly is especially well suited for installation in the frame of a house roof window. In this case it is possible that, when the window sash is closed the additional space with the filter is formed by means of the sash cover.

BRIEF DESCRIPTION OF THE DRAWINGS

The invention is explained below by means of a specific embodiment shown in the drawing.

DETAILED DESCRIPTION OF THE PREFERRED EMBODIMENT

Figure 1:
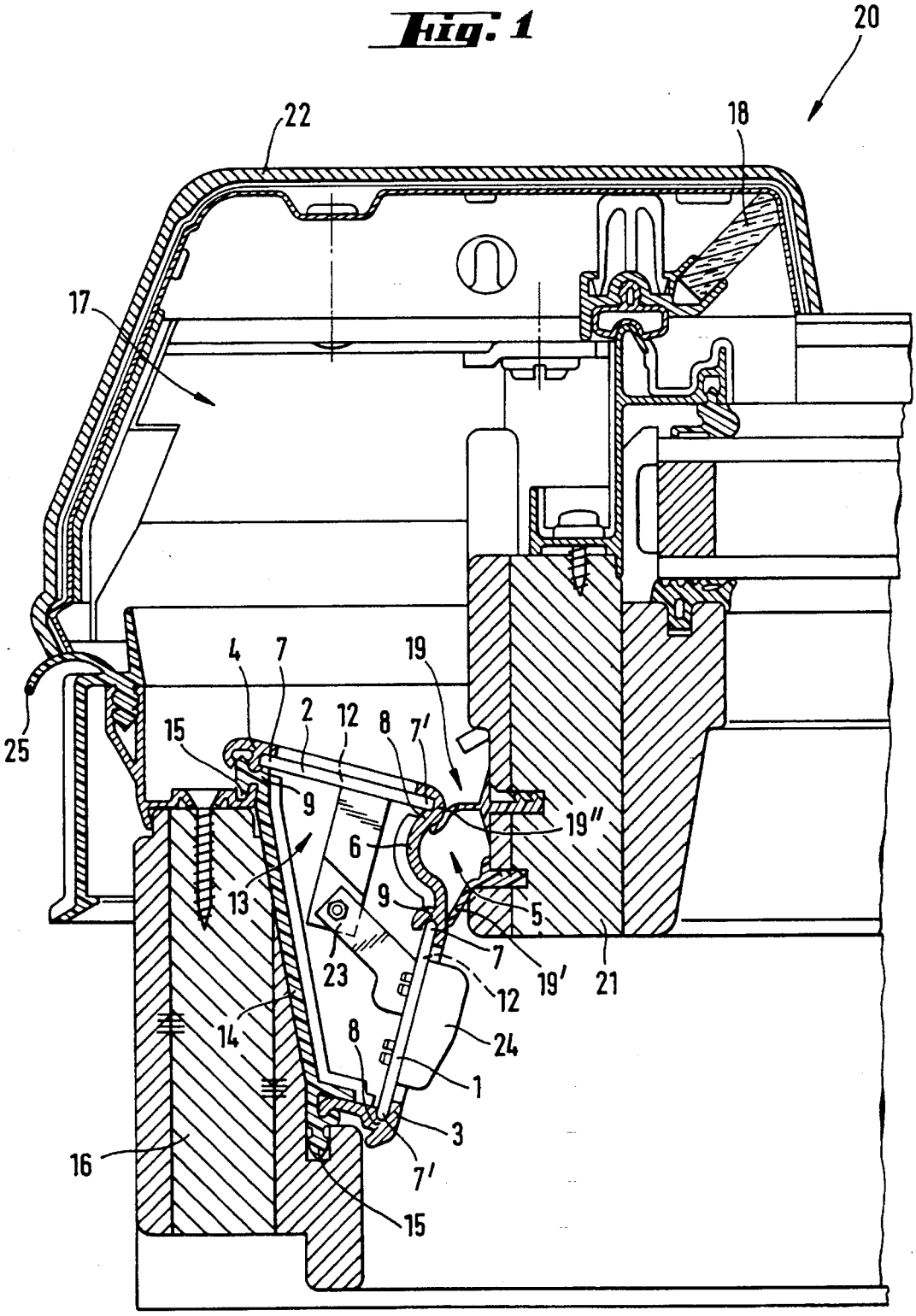
FIG. 1 shows a cross-section through a house roof window in the area of the slide ventilation assembly.

FIG. 1 shows a cross-section through a house roof window 20, which is equipped with a specific embodiment of the slide ventilation assembly in accordance with the invention. The main housing of the slide ventilation essentially consists of two walls 3,4 which run at a 90° angle to one another and between which there is a wall piece 6 providing a recess 5. This part can be made as a profile piece which, for example, can be connected with the profile section by means of a snap connection. On the inside of the walls 3, 4 there are two ventilation slides 1, 2 which are connected with one another by means of a coupling piece 23. In this way the ventilation slides 1, 2 slide at the same time when a handle 24 located on one of the ventilation slides 1,2 is operated. Openings 12 of the ventilation slides 1, 2 are brought into alignment and out of alignment with corresponding openings in the walls 3, 4 by moving the ventilation slides 1, 2, by means of which the slide ventilation assembly is opened or closed.

The ventilation slides 1, 2 are guided in U-shaped guides 8, 9 on the walls 3, 4 which seat their longitudinal edges 7, 7'. The slide ventilation assembly shown is inserted into the window frame 16 of the house roof window 20, for which connecting elements 15, which are located on the cover 14, are used. In this case there are pins which are inserted into a groove in the window frame 16, as well as a structure for hooking into a holding piece, which is fastened with a screw to the window frame 16. The wall piece 6 is configured so that it forms a double lip seal 19 with the window sash 21. The wall piece 6 has a bead 19" as well as a diagonal piece, which also interacts with sealing lips 19', which are mounted on the window sash 21.

In the case of the specific embodiment shown in FIG. 1 before the space 13 of the slide ventilation assembly, there is an additional enclosed space 17, in which there is disposed a filter 18. In this way, the outer air first has to pass through the filter 18, then through the additional space 17, and after that through the slide ventilation assembly. The space 17 is located under the sash cover 22, which is provided on the window sash 21. When the window sash is closed, there is a gasket 25 thereon which ensures that the outside air has access to the additional space 17 under the sash cover 22 only through the filter 18.

Figure 2:
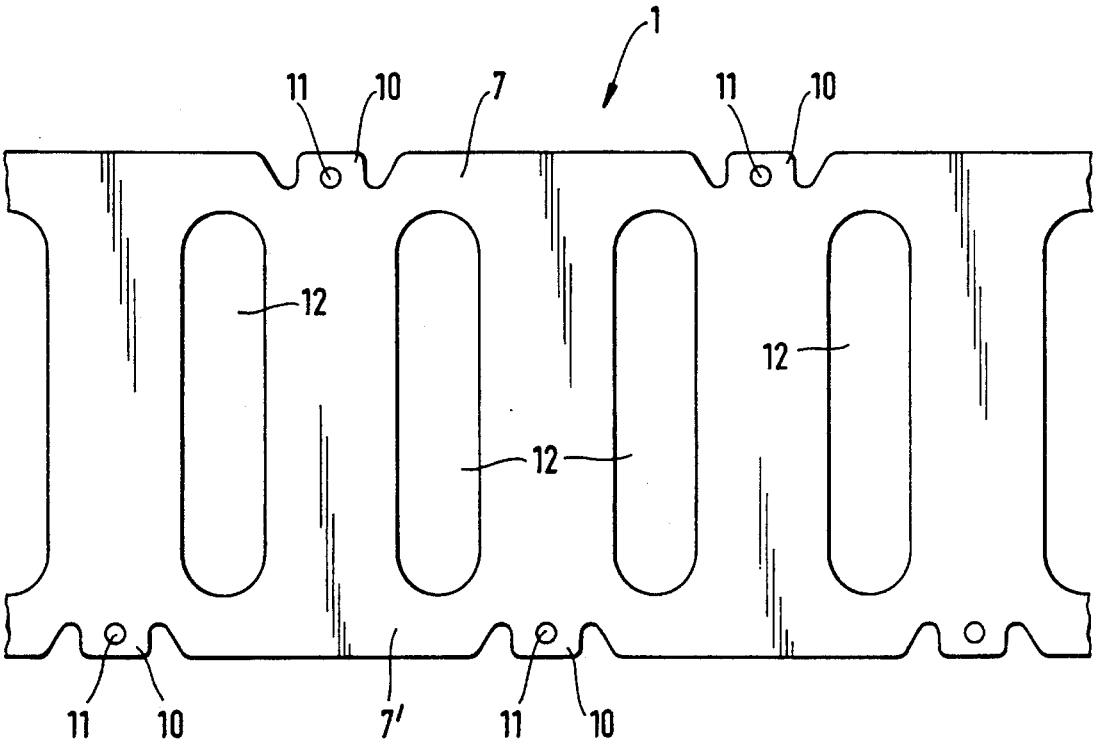
FIG. 2 fragmentarily shows an embodiment of a slide.

FIG. 2 fragmentarily shows a specific embodiment of the ventilation slide 1 or 2. The openings 12 which cooperate with corresponding openings 12 in the walls 3 or 4 are to be seen as openings 12 made as slots. Depending on the position of the ventilation slide, the openings 12 either coincide or are covered by the cross-pieces lying between them in such a way that the slots 12 in the walls 3, 4 are completely covered. In order to obtain stable positioning of the ventilation slides 1, 2 on the walls 3, 4, it is possible to make tongues 10 which push against the guides 8, 9 in such a way that the ventilation slides 1, 2 bear snugly against the walls 3, 4. The tongues 10 have to have for this purpose a slight offset 26 in the direction of the inside of the ventilation slide and/or they are provided with knobs or protuberances 11, which provide compression pressure. A suitable embodiment of the tongues 10 provides that the tongues 10 located on the edges 7, 7' be offset on one side by a half spacing from those on the other side by means of which the friction is reduced further and greater tolerances can be compensated.

Figure 3:
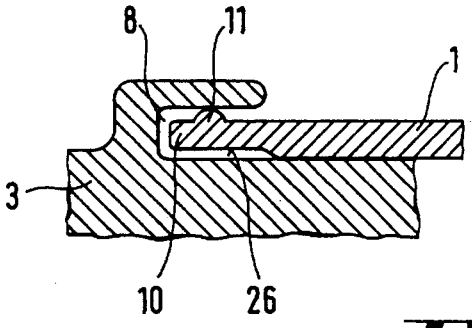
FIG. 3 is a fragmentary sectional view which shows the guide of such a slide.

FIG. 3 shows a cross-section through one of the guides 8 with a partial piece of the ventilation slide 1 with a tongue 10, which is equipped with a knob or protuberance 11. The offsets 26 in the tongues 10 ensure that the ventilation slides 1, 2 are pressed against the walls 3, 4.

Figure 4:
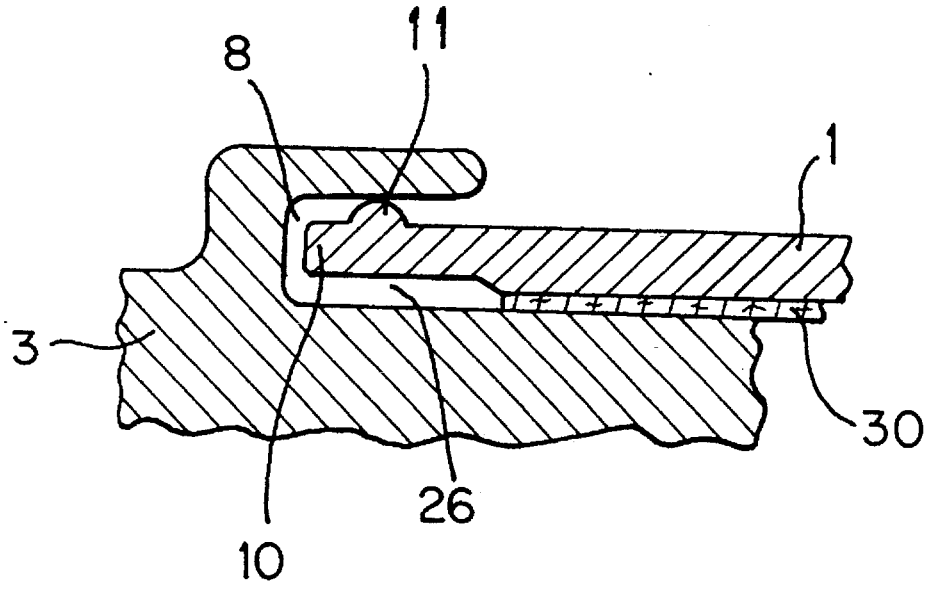
FIG. 4 is a similar fragmentary sectional view showing an embodiment in which a fiber web is interposed between the slide and wall.

Other designs also are conceivable, for example often it is sufficient to provide only one of the ventilation slides 1 or 2 with tongues 10 or knobs 11. Also further measures increasing the sealing instead of these are conceivable, for example, the mounting of a fiber web 30 on the side of a ventilation slide 1, which is disposed toward the wall 3, or on the side of the wall 3 which is disposed toward the ventilation slide 1, as seen in FIG. 4, to improve sealing and insulation.

I claim:

1. A slide ventilation assembly for a roof window installation including (a) a multiplicity of elongated walls defining an enclosed space, two of said walls extending at 90° to one another and having apertures spaced along the length thereof, and a connector wall piece disposed between the adjacent ends of said two walls;

(b) elongated ventilation slides slidably mounted on each of said two walls and having apertures spaced along the length thereof, said slides being slidable between a first position in which the apertures in said slides and in their associated walls are aligned;

(c) connector means connecting said slides for concurrent movement thereof; and (d) manipulatable operator means for moving said slides to effect alignment of said apertures in said slides with said apertures in said walls to allow air to pass through said walls and enclosed space.

2. The slide ventilation assembly in accordance with claim 1 wherein at least one of said ventilation slides (1, 2) has its longitudinal side edges (7, 7') seated in U-shaped guides on its associated wall (8, 9), and wherein tongues (10) on said side edges (7, 7') of the ventilation slide (1, 2) bear against the guides (8, 9).

3. The slide ventilation assembly in accordance with claim 2 wherein said tongues (10) have projections (11) thereon.

4. The slide ventilation assembly in accordance with claim 2 wherein said tongues (10) along one of said longitudinal side edges (7, 7') are longitudinally offset from those along the other longitudinal side edge.

5. The slide ventilation assembly in accordance with claim 1 wherein at least one ventilation slide (1, 2) has a fiber web on its surface disposed toward said wall (3, 4).

6. The slide ventilation assembly in accordance with claim 1 wherein at least one of said walls (3, 4) has a fiber web on its surface adjacent said ventilation slide (1, 2).

7. The slide ventilation assembly in accordance with claim 1 wherein said walls (3 4) and said wall piece (6) are fabricated as a single section which is joined to a cover (14) to enclose said space (13).

8. The slide ventilation assembly in accordance with claim 1 wherein said cover (14) has connecting elements (15) thereon for connection to the frame of an associated window installation.

9. A roof window installation comprising:

(a) a frame;

(b) a sash pivotably supported on said frame for movement between open and closed positions; and (c) a slide ventilation assembly comprising:

(i) a multiplicity of elongated walls defining an enclosed space, two of said walls extending at 90° to one another and having apertures spaced along the length thereof, and a connector wall piece disposed between the adjacent ends of said two walls;

(ii) elongated ventilation slides slidably mounted on each of said two walls and having apertures spaced along the length thereof, said slides being slidable between a first position in which the apertures in said slides and in their associated walls are aligned;

(iii) connector means connecting said slides for concurrent movement thereof; and (iv) manipulatable operator means for moving said slides to effect alignment of said apertures in said slides with said apertures in said walls to allow air to pass through said walls and enclosed space.

10. The roof window installation in accordance with claim 9 wherein at least one of said ventilation slides (1, 2) has its longitudinal side edges (7, 7') seated in U-shaped guides on its associated wall (8, 9), and wherein tongues (10) on said side edges (7, 7') of the ventilation slide (1, 2) bear against the guides (8, 9) .

11. The roof window installation in accordance with claim 10 wherein said tongues (10) have projections (11) thereon, said tongues (10) along one of said longitudinal side edges (7, 7') are longitudinally offset from those along the other longitudinal side edge.

12. The roof window installation in accordance with claim 9 wherein said walls (3, 4) and said wall piece (6) are fabricated as a single section which is joined to a cover (14) to enclose said space (13), said cover (14) has connecting elements (15) thereon connect said frame.

13. The roof window installation in accordance with claim 9 wherein slide ventilation assembly includes a fiber web on one of the opposed surfaces of said slide and wall.

14. The roof window installation in accordance with claim 9 wherein said sash and frame cooperate to define an additional closed space in said closed position of said sash and said sash includes a filter communicating with the outer surface thereof and with said additional closed space whereby fresh air is supplied through said additional space (17) and said filter (18) from the outside environment.

15. The roof window installation in accordance with claim 9 wherein parts (19',19") of a lip seal (19) are disposed between said sash and said wall piece (6) in the closed position of said sash.

16. The roof window installation in accordance with claim 14 wherein said additional space (17) is enclosed by the base plate (22) of said closed window sash (21) of said window installation.

* * * * *